US007096949B2

(12) United States Patent
Weber et al.

(10) Patent No.: US 7,096,949 B2
(45) Date of Patent: Aug. 29, 2006

(54) WIPER PLUG WITH PACKER

(75) Inventors: James L. Weber, Calgary (CA); Lynn P Tessier, Cochrane (CA); John P. Doyle, Calgary (CA)

(73) Assignee: MSI Machineering Solutions Inc., Providenciales (TC)

( * ) Notice: Subject to any disclaimer, the term of this patent is extended or adjusted under 35 U.S.C. 154(b) by 0 days.

(21) Appl. No.: 10/933,240

(22) Filed: Sep. 3, 2004

(65) Prior Publication Data

US 2005/0051333 A1 Mar. 10, 2005

Related U.S. Application Data

(60) Provisional application No. 60/499,716, filed on Sep. 4, 2003.

(51) Int. Cl.
*E21B 23/10* (2006.01)
*E21B 33/12* (2006.01)
*E21B 33/16* (2006.01)

(52) U.S. Cl. ..... 166/291; 166/153; 166/192; 166/297; 166/386; 166/387

(58) Field of Classification Search ..... 166/291, 166/297, 386, 387, 153, 192
See application file for complete search history.

(56) References Cited

U.S. PATENT DOCUMENTS 2,305,282 A * 12/1942 Taylor, Jr. et al. ..... 92/241
2,791,278 A * 5/1957 Clark, Jr. ..... 277/338
4,078,810 A * 3/1978 Arendt ..... 277/336
4,671,358 A 6/1987 Lindsey, Jr. et al.
5,323,858 A * 6/1994 Jones et al. ..... 166/291
5,735,348 A 4/1998 Hawkins, III

* cited by examiner

*Primary Examiner*—George Suchfield
(74) *Attorney, Agent, or Firm*—Sean W. Goodwin; Linda M. Thompson

(57) ABSTRACT

A self-retaining cementing wiper plug with a packer element has two or more steel or carbide tipped holddown fingers or slips extending radially outward from the plug for engaging the inner surface of the casing and preventing the plug from moving uphole over time and potentially interfering with other downhole apparatus such as a pump. The packer element in the wiper plug is actuated when the plug is supported by an obstruction under the plug and then compressed, the packer being maintained in compression by the holddown fingers.

14 Claims, 12 Drawing Sheets

WIPER PLUG WITH PACKER

CROSS REFERENCE TO RELATED APPLICATION

This application is a regular application claiming priority of U.S. Provisional Patent application Ser. No. 60/499,716, filed on Sep. 4, 2003, the entirety of which is incorporated herein by reference.

FIELD OF THE INVENTION

The invention relates to cementing wiper plugs used in cementing casing downhole and particularly to top cementing plugs used for cementing production casing and further to wiper plugs integrating a packer for preventing uphole fluid flow from a lower zone.

BACKGROUND OF THE INVENTION

It is conventional practice, in the drilling and completion of wells, to case an open hole by cementing tubular casing in place in a wellbore. Thus, the open hole is prevented from caving in, fragile formations are protected, inter-zonal communication is restricted and contamination of groundwater is prevented. In the course of cementing the casing, components are placed in the well which can later migrate and possibly interfere with well operations. To understand the phenomena, cementing operations are reviewed herein.

A string of casing is made up and lowered into the open wellbore. Prior to the placement of cement, the casing and hole are filled with drilling mud, which must be displaced for placing cement.

In the case of surface and intermediate casing, in order to reduce contamination of the interface between the displaced mud and the cement, a bottom cementing plug is placed in the casing and pumped ahead of the cement slurry. The bottom plug is typically constructed with a one piece hollow metallic or a one piece non-metallic core having an elastomeric covering molded to the core. The elastomeric cover typically incorporates a plurality of wipers. The function of the wipers is to wipe the internal surface of the casing, maintain the separation of fluids during the displacement of the cement slurry down the casing and provide a means of sealing upon displacement of the plug. The bottom plug incorporates a rupture diaphragm or valve that will rupture or open upon the bottom plug reaching or resting on a float shoe, float collar or landing collar located near or at the bottom of the casing. As a result, the bottom plug is supported and restrained from further downhole movement.

An increase in fluid pressure above the supported bottom plug results in the diaphragm rupturing, allowing the cement slurry to pass though the bottom plug and continue out the bottom of the casing, beginning to fill the annular space between the casing and the well bore.

When the necessary volume of cement has been placed into the casing, a top plug is positioned on top of the cement for separating the cement from a displacement fluid. The top plug is typically constructed having a solid elastomer, one piece metallic or one piece non-metallic core having an elastomeric covering molded to the core, the elastomeric cover incorporating a plurality of wipers.

Optionally, the top plug may also have a rupture element, as described in U.S. Pat. No. 5,191,932 and incorporated herein by reference in its entirety, so that if the top and bottom plugs are inadvertently reversed, in operation, cementing can continue without removal of the plug or removal of cement placed into the wellbore before the error was discovered.

Pressures required to rupture the diaphragm are such that the diaphragm will not rupture during normal operations. The function of the wipers is to wipe the internal surface of the casing, maintain the separation of fluid during the displacement of cement slurry down the casing using displacement fluid and to provide a method of providing a sealing mechanism across the casing upon landing the top plug on top of the bottom plug. When displacement of the cement slurry is complete, the top plug will land on top of the bottom plug and is expected to remain in this position once the cement hardens.

After the cement slurry has become hard, the top and bottom plugs are drilled out. Additional drilling of the wellbore can then proceed through the cemented casing. Additional lengths of casing are hung in the cemented casing and the cementing operation is repeated to cement the additional lengths of casing into place.

The last segment of casing to be positioned in the wellbore is the production casing. It is typically smaller in diameter than either the surface or intermediate casing and extends to the bottom of the wellbore. As no further drilling will occur after the production casing has been run in and cemented, the plugs are not drilled out, but instead are left cemented into the bottom of the hole. As with the previous cementing operations, a bottom plug is run ahead of the cement and a top plug is run behind. Once the top plug rests on the bottom plug, pressure sufficient to keep the plugs at the bottom of the hole, but not to rupture the diaphragm in the top plug, if present, is maintained on the plugs for approximately 8 hours to permit the cement to properly set.

Once the wellbore has been cased, the casing is perforated above the plugs at a zone of interest and the wellbore is ready for production. A tubing string and pump are lowered into the casing and fluids are produced up the tubing string to surface.

Applicant is aware that in many cases, often a year or more after the cementing of the casing, the top cementing plug can migrate up the production casing to the pump intake and cause fouling of the pump. Typically, most wellbores have a minimum overhole, that is to say, the bottom of the casing is not far below the zone to be perforated. Applicants believe that during perforation of the casing, the cement surrounding the plugs and outside the casing may be fractured. If sufficient fracturing occurs, the plugs are no longer held securely inside the casing and can migrate upwards. It is also possible that gas from the formation can travel downward through the fractured cement outside the casing and rise at the bottom of the casing to apply pressure on the plugs. If one-way valves in the float equipment are also damaged as a result of pressure pulses during perforation, are washed out during cementing or have material trapped therein, against a seat, preventing closure, then the plugs may be forced upwards due to the increased pressure from below.

Traditionally, whenever the pump intakes are fouled, production is lost and the tubing is tripped out of the well to repair the pump, at great expense. A solution that has been employed to prevent plugs from migrating upwards into the pump intake is to run a bridge plug into the casing and set it down on the top cementing plug to anchor the plug in position. Whether repairing the pump or setting a bridge plug, significant expense is involved in both equipment and rig time.

Applicant, in corresponding U.S. application Ser. No. 10/640,056, filed Aug. 14, 2003 and claiming foreign priority benefits of Canadian Patent Application 2,406,748, filed Oct. 3, 2002, both of which are entitled SELF-ANCHORING CEMENTING WIPER PLUG, the entirety of which are incorporated herein by reference, describes a self-retaining cementing wiper plug which solves the problems related to migration using two or more holddown fingers biased radially therefrom and extending outward for engaging an inner surface of the casing once the plug is positioned at the bottom of the casing. Substantially, regardless of the formation, the novel plug is prevented from migration. The holddown fingers are angled uphole, as are the wipers, to enable insertion into the casing bore and are flexible relative to the plug only in so much as the elastomeric body in which they are embedded flexes or the attachment to the core of the plug permits limited flex, to permit insertion. The fingers themselves are substantially inflexible so as to resist flexing once engaged with the casing to prevent movement of the plug uphole.

It is important to note that a wiper plug is designed to prevent fluid flow downhole past the plug and can permit uphole flow. However, when used as a top wiper plug, differential pressure across the plug can cause fluids to flow from a lower zone which is undesirable once the top wiper plug has been set.

Regardless of the reason or hypothesis for plug migration, clearly there is a need for means to prevent the cementing plug from migrating up the casing. Ideally, such means would be incorporated directly into the plug, thus realizing significant cost and time savings and further, there is a need for a device for blocking uphole fluid flow once the top plug is in place.

SUMMARY OF THE INVENTION

A novel wiper packer plug or cementing plug having sealing elements for preventing uphole fluid flow is used as a top wiper plug. The wiper packer plug incorporates a packer for sealing a wellbore having a casing. The wiper packer plug comprises: a plurality of radially extending, elastomeric wipers extending from the cementing plug for insertion into a production casing, further comprising one or more substantially inflexible projections biased radially outward from the cementing plug and angled uphole, wherein, the one or more projections are moveable inwardly sufficiently so as to permit movement downwardly into the casing and are sufficiently inflexible to engage the casing to prevent uphole movement of the plug in the casing; and an elastomeric packer element formed at the bottom of the cementing plug, the packer element actuable between an insertion diameter and an expanded diameter so as to engage the inside of the casing and seal the wellbore against leakage of fluids from below the cementing plug when in the expanded diameter.

Preferably, the packer is actuable upon compression of the wiper plug against an obstruction in the wellbore such as a bottom cementing plug, as a result of fluid pressure above the cementing plug, the compression being maintained by the projections even if the fluid pressure is removed.

In other aspects of the invention, a unique cementing top wiper plug assembly is provided for use in a casing bore to preventing leakage of fluids from below the plug following perforation of the casing comprising: a body having a plurality of elastomeric vanes extending outward radially therefrom for wiping the inside of the casing during insertion into the casing bore; two or more holddown projections extending from the body for engaging the inside of the casing bore and preventing the top plug from floating upwards inside the casing bore following insertion into the bore; and an elastomeric packer element formed in the body, the packer element actuable between an insertion diameter and an expanded diameter so as to engage the inside of the casing and seal the wellbore against leakage of fluids from below the plug when in the expanded diameter. Actuation of the packer element is through hydrostatic compression of the top plug supported on the bottom plug. The packer is held in its actuated position by the holddown projections.

In another aspect, the incorporation of a packer element into the wiper plug enables a method of cementing a casing into a wellbore without the need for a float shoe or other one way valves. The method comprises: pumping a bottom plug to the bottom of a casing string until the plug is landed on the guide shoe or float collar; pumping a column of cement; pumping a top plug following the cement; pumping displacement fluid to force the column of cement to open a rupture element or valve in the bottom plug to cause the cement to be displaced into the wellbore annulus; and pumping displacement fluid to actuate the packer element in the top plug to the expanded diameter for sealing against the casing and preventing cement from re-entering or U-tubing into the casing bore.

Advantageously, when running in the casing, the casing will fill with displacement fluid by itself without having to stop every 200–300' to add fluid, therefore it is no longer necessary to provide a one way valve to prevent fluid rising in the casing. Only when the top plug rests on the bottom plug and the packer is set is fluid prevented from rising in the casing.

In another embodiment, a method of cementing and sealing the wellbore from leakage of fluids below the perforations is provided, comprising: pumping a bottom plug to the bottom of a casing string until the plug is landed on the guide shoe; pumping a column of cement; pumping a top plug following the cement; pumping displacement fluid to force the column of cement to open a rupture element in the bottom plug to cause the cement to be displaced into the wellbore annulus; pumping displacement fluid to actuate the packer element in the top plug to the expanded diameter for sealing against the casing and preventing cement from re-entering into the casing; permitting the cement to harden and cure; and perforating the casing above the top plug, the packer element preventing leakage uphole past the top plug.

BRIEF DESCRIPTION OF THE DRAWINGS

FIG. 7*a* is a side view of a wiper plug with packer set onto a bottom plug for actuation of the resilient reverse wiper packer element, FIG. 7*b* is an isometric top view of the packer wiper, FIG. 7*c* is a top view of the packer wiper, FIG. 7*d* is an isometric bottom view of the packer wiper, and FIG. 7*e* is a bottom view of the packer wiper; FIG. 8*a* is a partial longitudinal sectional view showing a soft durometer rubber packer element sandwiched between a bottom post in a first running in position and an uphole retaining shoulder, all of which is shown prior to actuation, and FIG. 8*b* is a partial longitudinal sectional view illustrating the wiper packer having been placed atop a bottom wiper and compressed thereon to shear the bottom post and permit compression of the packer element for sealing the wellbore.

DETAILED DESCRIPTION OF THE PREFERRED EMBODIMENT

The Self-Retaining Wiper Plug

Figure 1:
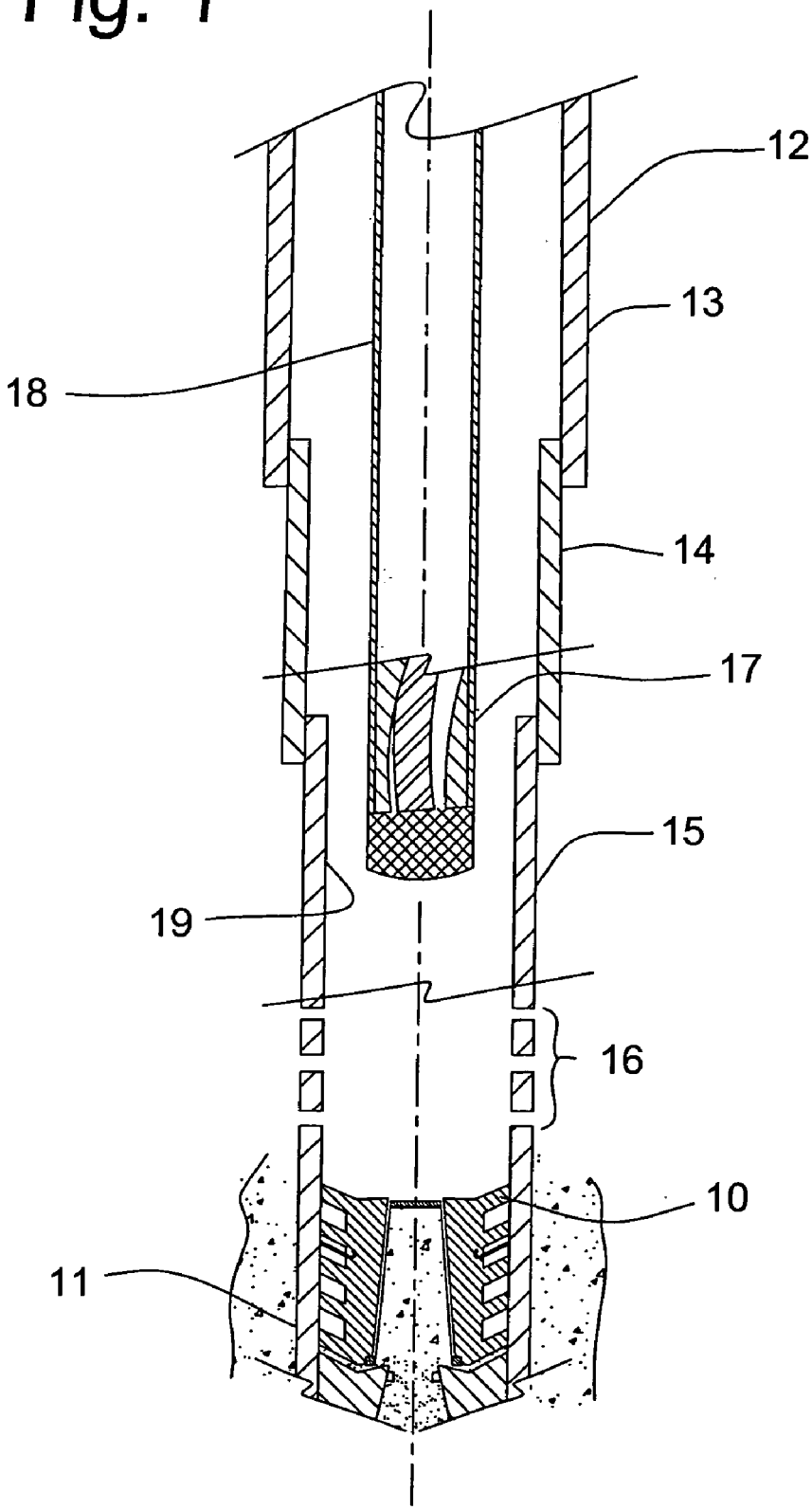
FIG. 1 is a schematic cross-sectional view of a wellbore casing string having a top cementing plug of the present invention positioned on or adjacent a bottom end of the production casing.

Having reference to FIG. 1, a cementing plug 10 is shown positioned adjacent a bottom 11 of a casing string 12 comprising, in order beginning from surface (not shown): surface casing 13, intermediate casing 14 and production casing 15. The cementing plug 10 is located below a plurality of perforations 16 in the production casing 15 and below a pump 17 lowered into the casing 12 at the end of a production string 18.

Figure 2:
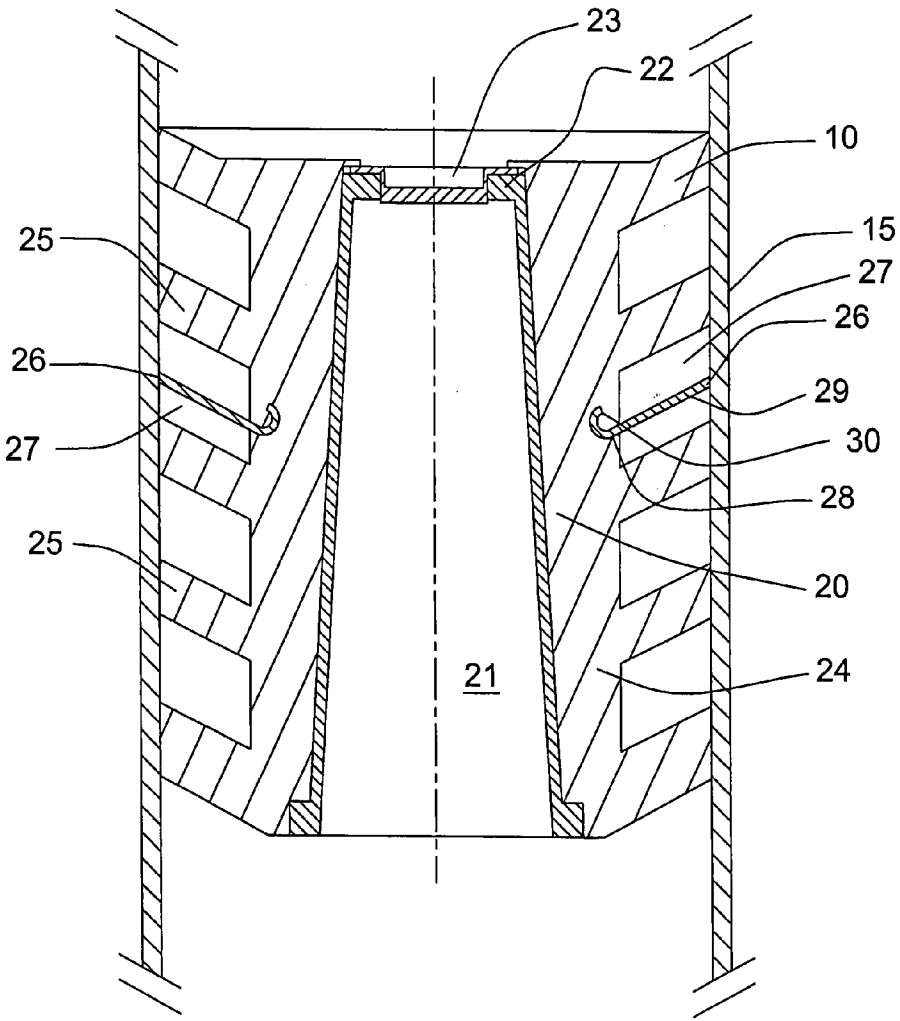
FIG. 2 is a cross-sectional view of a first embodiment of the invention according to FIG. 1 and showing holddown fingers embedded in the cementing plug and protruding between the wipers for engaging the production casing.

As shown in FIG. 2, and in a preferred embodiment of the invention, the cementing plug 10 comprises a core 20. The core 20 is covered with an elastomeric covering 24 having a plurality of wipers 25 formed thereon. Preferably, the core 20 defines a bore 21 therethrough. A top end 22 of the core 20 is fitted with a rupture element 23 to permit the passage of cement slurry during cementing should the plug 10 be used inadvertently as a bottom wiper plug. Typically, the rupture element 23 is designed to rupture only at a predetermined pressure. The wipers 25 extend radially outward from the core 20 and elastomeric covering 24 and are angled uphole slightly to permit flexing for insertion through the production casing 15. The wipers 25 act to wipe an inner surface 19 of the casing 15 and maintain separation between fluids above and below the cementing plug 10 during its insertion.

Two or more substantially inflexible projections, preferably radially extending holddown fingers 26, are formed in a space 27 defined by two of the plurality of wipers 25 extending from the cementing plug 10. A first end 28 of the holddown fingers 26 is embedded in the elastomeric covering 24 and a second end 29 extends at least equal to the extent of the flexed wipers 25 so that when the cementing plug 10 is positioned in the production casing 15, the second end 29 engages the inner wall 19 of the casing 15. The holddown fingers 26 are positioned to angle slightly uphole and are permitted limited flexing to aid in insertion of the cementing plug 10 into the casing 15 as a result of flexing of the elastomeric covering 24, however, once positioned at the bottom 11 of the casing 15, any uphole movement of the cementing plug 10 is prohibited as a result of limited rotation and compression of the holddown fingers 26 through engagement of the second end 29 of the holddown fingers 26 with the casing's inner wall 19. Typically, the holddown fingers 26 are manufactured from spring steel and may be tipped with carbide. The fingers 26 are substantially inflexible so as to be incapable of flexing or displacing overly so as to prevent the second ends 29 from losing their grip and disengaging from the casing's inner wall 19 in response to pressure from below the plug 10.

In a preferred embodiment, as shown in FIG. 2, two spring steel holddown fingers or carbide holddown fingers 26 are positioned 180 degrees circumferentially from one another about the plug 10. The holddown fingers 26 are blade-like, being approximately 1.5 inches in length and 1 inch in width and are angled to approximately the same degree as the wipers 25. Preferably, the first end 28 of each finger 26 is profiled or curved to form an anchor 30 so as to be more securely embedded in the elastomeric covering 24. Applicant has found that two holddown fingers 26 are sufficient to secure the cementing plug 10 in the casing 15, under test conditions. One holddown finger 26 may be sufficient as the wipers 25 already act to center the plug 10.

Figure 4:
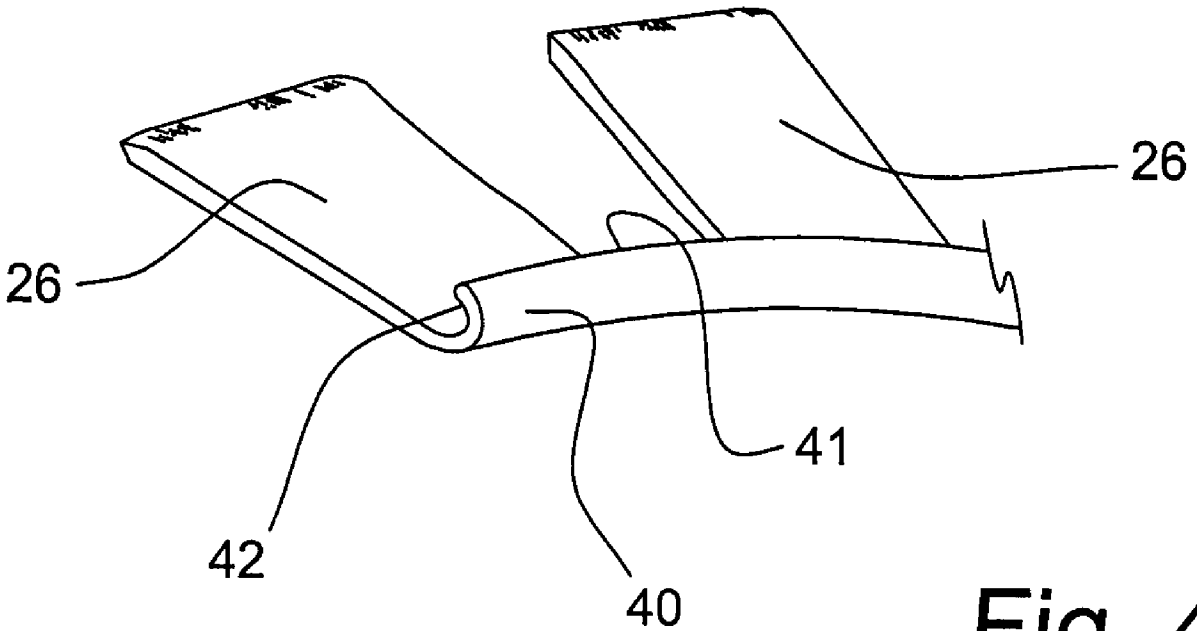
FIG. 4 is a partial perspective view of a ring to be secured around a core of the cementing plug and having a plurality of angled holddown fingers radially extending therefrom for engaging the casing.

A plurality of holddown fingers 26 may be spaced circumferentially about the plug individually, or joined as shown in FIG. 4. Each finger 26 may be separately embedded in the elastomeric covering 24 or, as shown in FIG. 4, for ease of production, the plurality of angled holddown fingers 26 may extending radially and cantilevered from a ring 40. The ring 40 can be embedded in the elastomeric covering 24 about the core 20. Further, an inner edge 41 of the ring 40 can be profiled as an anchor 42 for better securing the ring 40 in the elastomeric covering 24.

Figure 3:
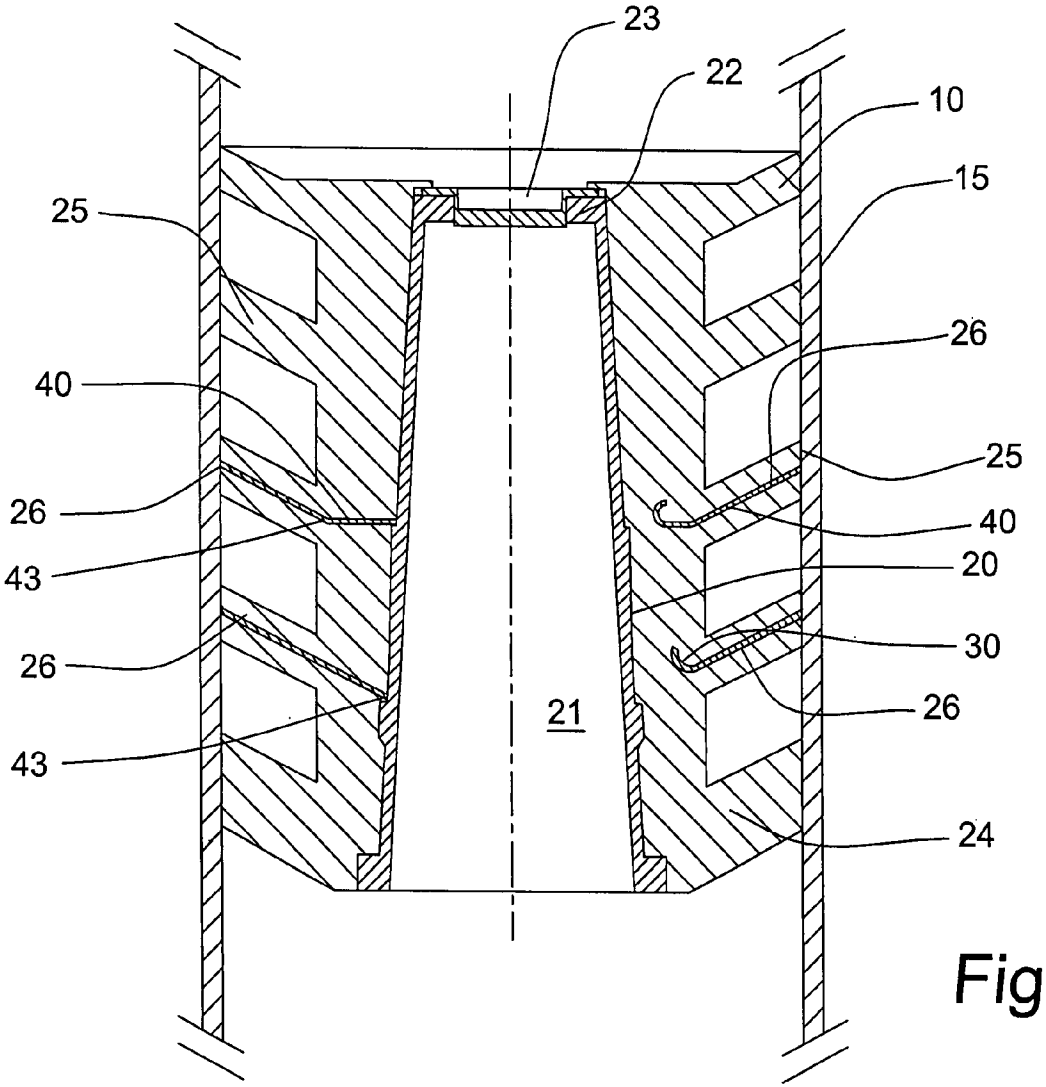
FIG. 3 is a cross-sectional view of a second embodiment of the invention showing spring steel holddown fingers and carbide-tipped holddown fingers embedded in the wipers of the cementing plug for engaging the production casing.

Having reference again to FIG. 3, and in another embodiment, the holddown fingers 26 can be embedded within the elastomeric wipers 25. As is the case with the previously described embodiment, the holddown fingers 26 can be discrete and embedded individually within the wipers 25 or can extend periodically from a ring 40 which can be embedded about the core 20. Individually, the holddown fingers 26 may extend from the cementing plug's core 20 or may have an anchor 30 formed at the first end 28 permitting the finger 26 to extend from within the elastomeric covering 24.

For imparting further compressive strength, the holddown fingers 26 extending from the core 20 rest upon a shoulder 43 formed about the core 20 and provide additional resistance to inward flexing of the fingers 26.

Figure 5:
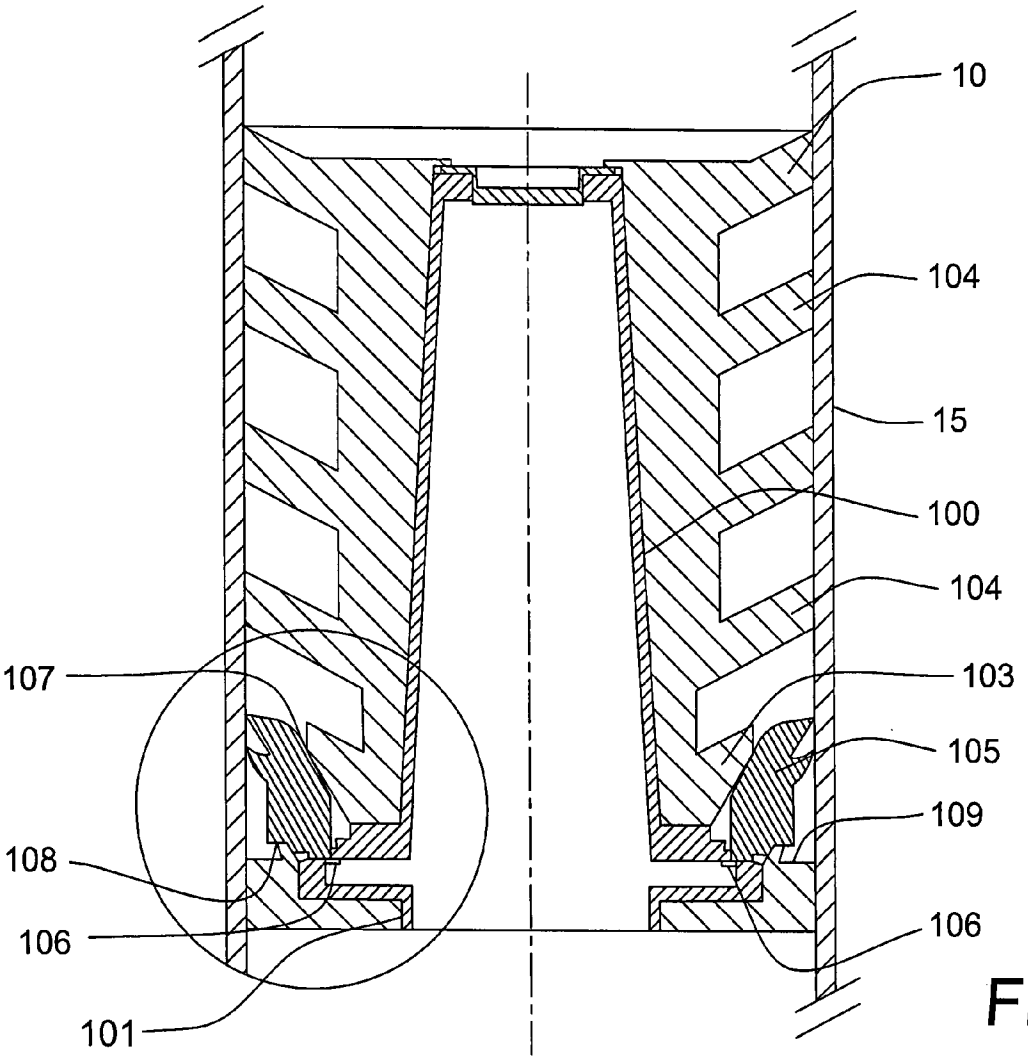
FIG. 5 is a cross-sectional view of a third embodiment of the invention showing a plurality of slips having carbide tips at a bottom end of the plug for engaging the production casing, the slips in a non-engaged position for insertion into the casing.

Having reference to FIG. 5, another embodiment is shown. The plug's core 20 is formed in two portions, an upper core 100 and a lower core 101. A unitary elastomeric covering 103 is formed over both the upper and lower core 100, 101 from which a plurality of upwardly angled wipers 104 extend. A plurality of slips 105 are shearably connected between the upper and lower core 100, 101, preferably by shear tabs 106. The slips 105 reside in openings or ports 107 in the elastomeric covering 103, proximate to the bottom of the core's upper portion 100. In a casing non-engaging position, the slips 105 are retracted sufficient to permit insertion of the plug 10 into the casing 12. A stop 108 is formed in the elastomeric covering 103 adjacent a base 109 of the slip 105 and is deformed outwardly by the slip 105, biasing the slip 105 into the port 107.

Figure 6:
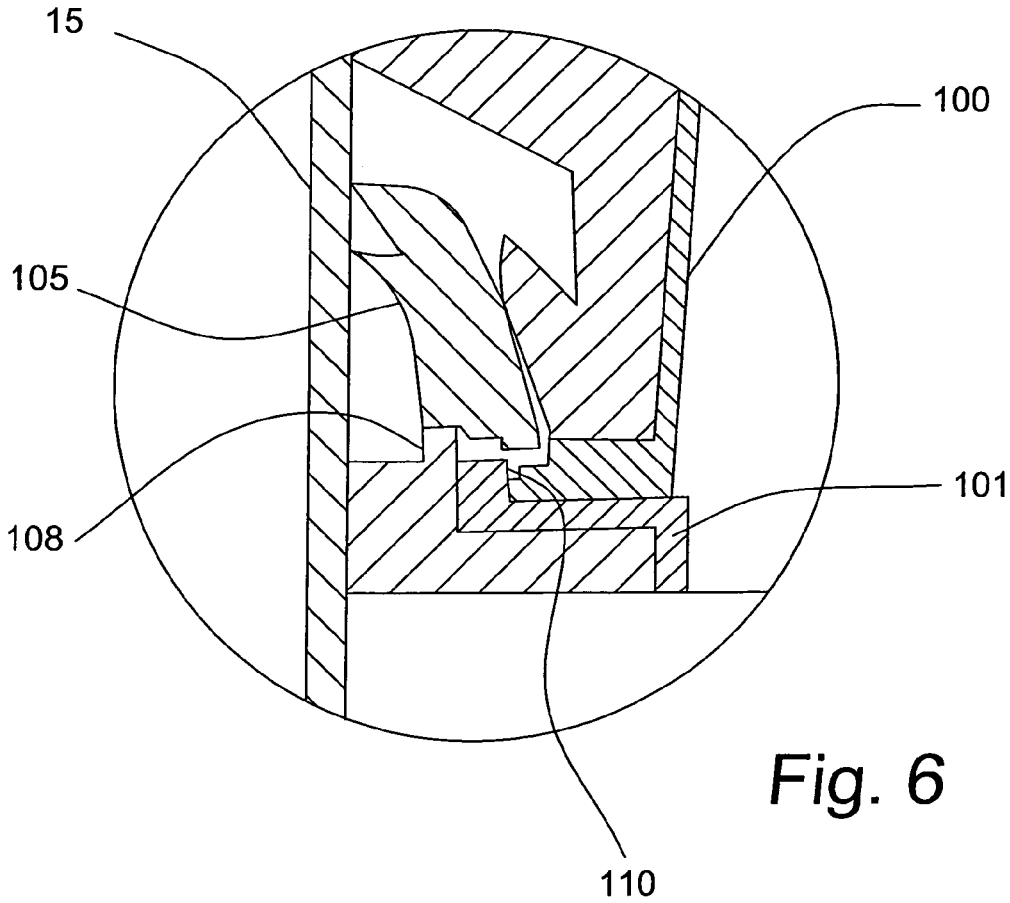
FIG. 6 is a cross-sectional view of the third embodiment according to FIG. 5 wherein a shear surface has been sheared and the slips are caused to be positioned in an engaged position.
Figure 7A:
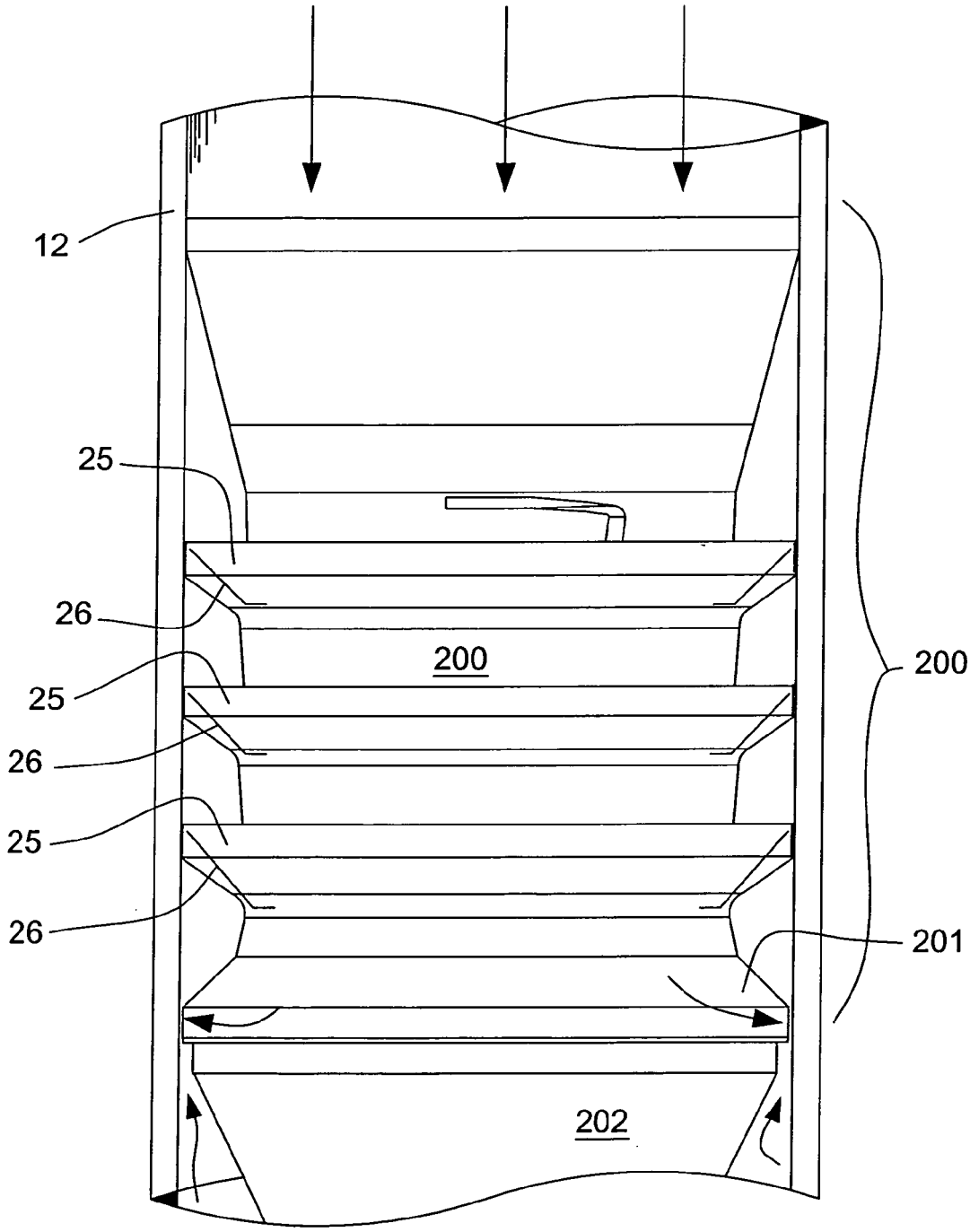
FIGS. 7*a*–7*e* are a series of views of one embodiment of the packer element all according to FIG. 7*a*, more particularly
Figure 7B:
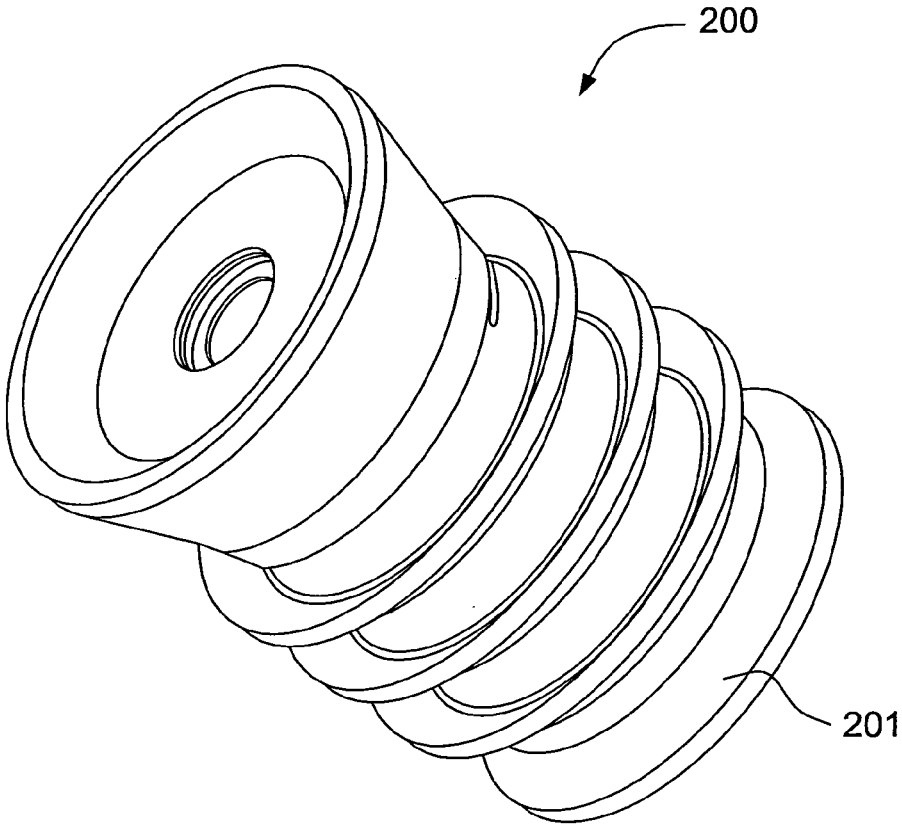
Figure 7C:
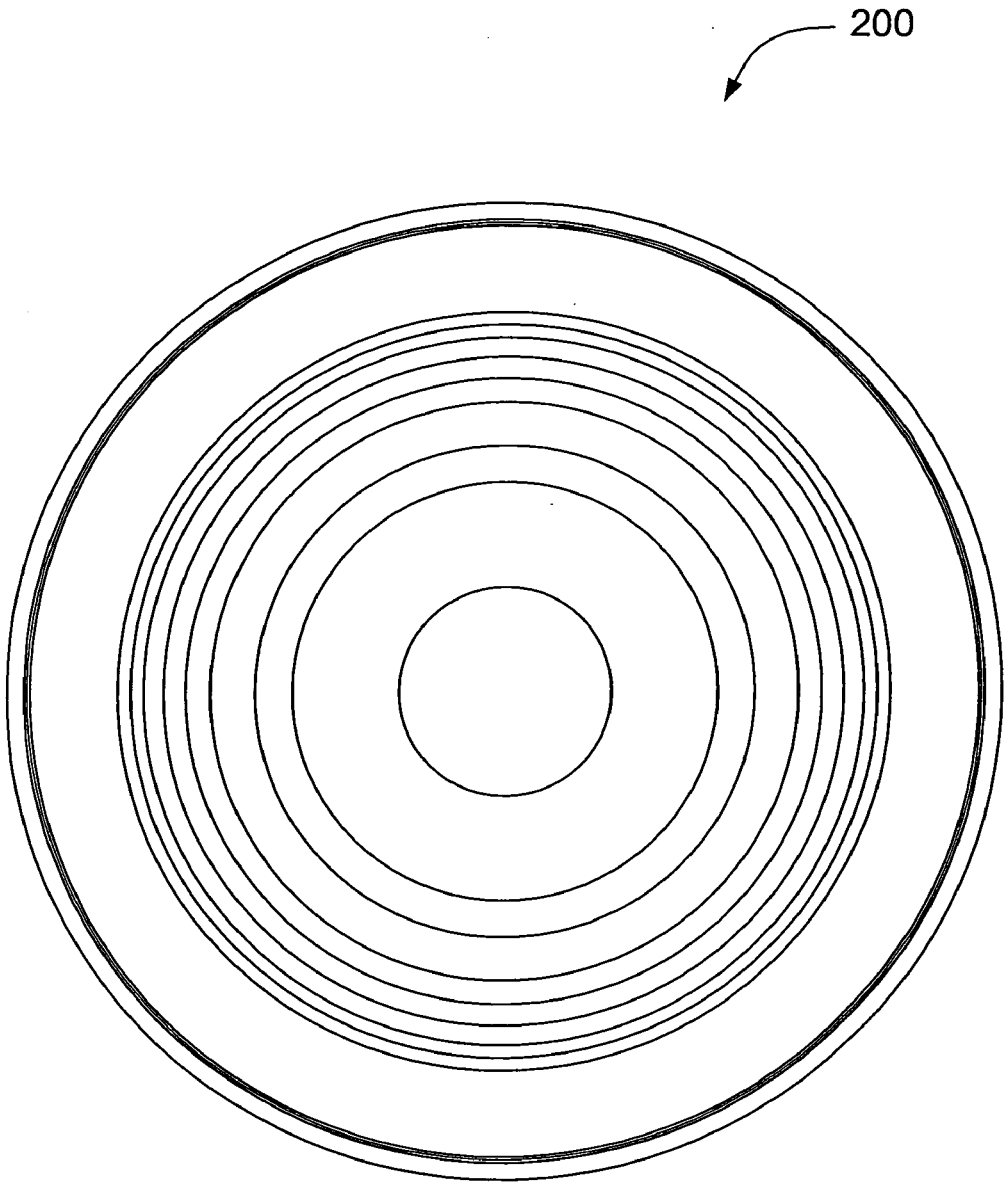
Figure 7D:
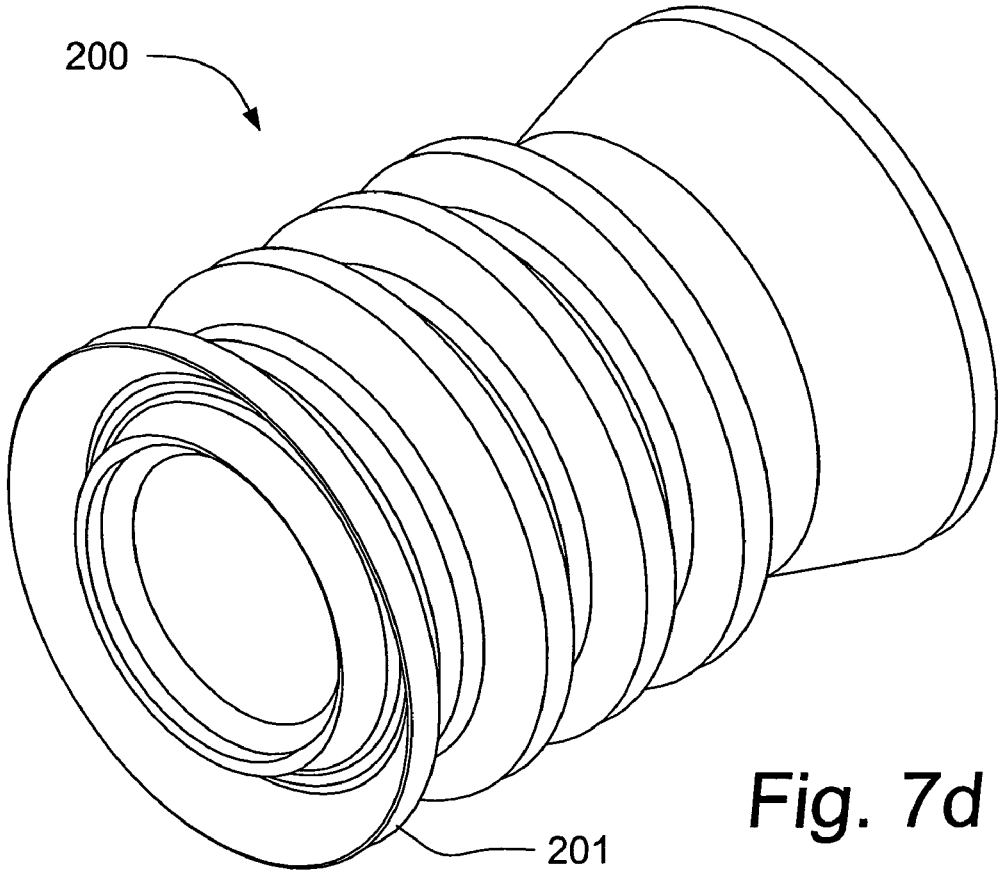
Figure 7E:
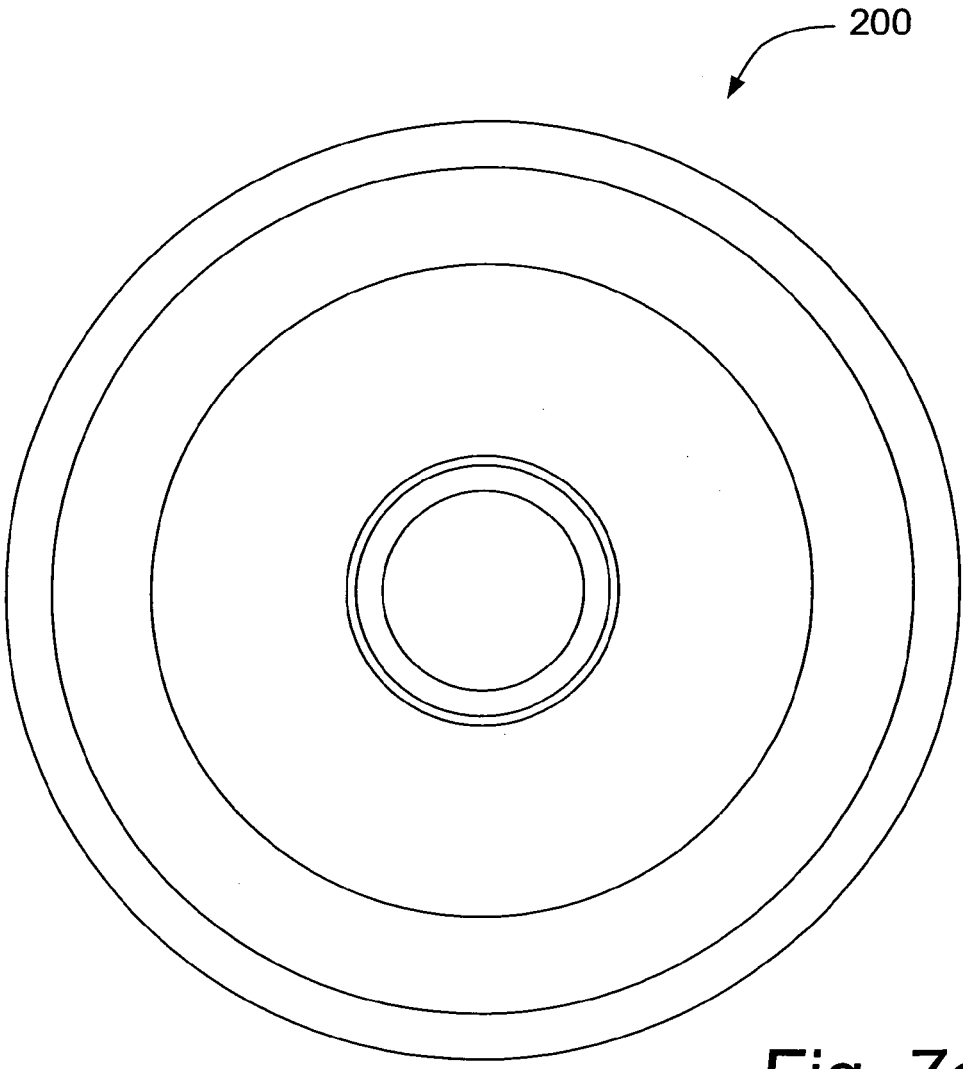

In operation, as shown in FIG. 6, once the top plug 10 is set upon the bottom plug (not shown) and pressure is applied as a result of displacement fluid, the upper core 100 is forced downward into a recess 110 formed in the lower core 101 causing the shear tabs 106 to shear. The elastomeric covering 103 deforms inward forcing the slips 105 outward into engagement with the production casing 15. The movement of the slip 105 releases the stop 108 from compression and the stop 108 is permitted to return inwardly to an upstanding position and aid in maintaining the position of the slips 105, tipped in the casing-engaging position.

The Packer Element

With reference to FIGS. 7*a*–7*e*, an embodiment of the wiper packer plug 200 is shown having wipers 25 and holddown fingers 26. An elastomeric packer element 201 is formed at a bottom of the plug 200, similar in configuration to the wipers 25, only inversed to extend downhole. The packer element 201 has an undeformed insertion diameter less than the casing diameter so that it is non-interfering during running into the casing. When used as a top wiper plug, and when bottomed onto an obstruction in the wellbore, such as a bottom cementing plug 202, the packer element 201 is compressed, typically against a bottom plug to deform the packer element outwardly to an expanded diameter to seal against an inside of the casing thereby preventing the uphole flow of fluids around the top wiper packer plug.

Typically, the compression and deformation is a result of hydraulic pressure applied to the plug as a result of displacement fluid pumped into the casing. More particularly, the flow of displacement fluid, used to flow the top packer plug 200 into the casing following the cement, is continued so as to provide sufficient pressure to compress the packer element 201 into sealing engagement with the casing, but is below the pressure at which the rupture element 23 will rupture.

Figure 8B:
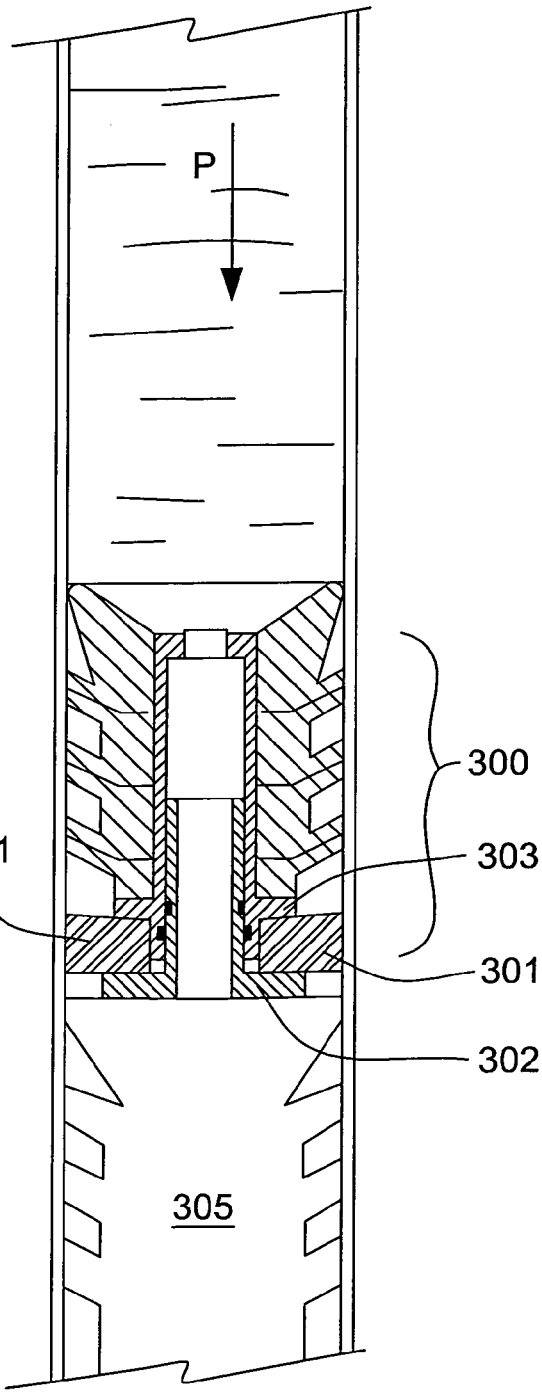
FIGS. 8*a* and 8*b* illustrate another embodiment of the invention, more particularly.
Figure 8A:
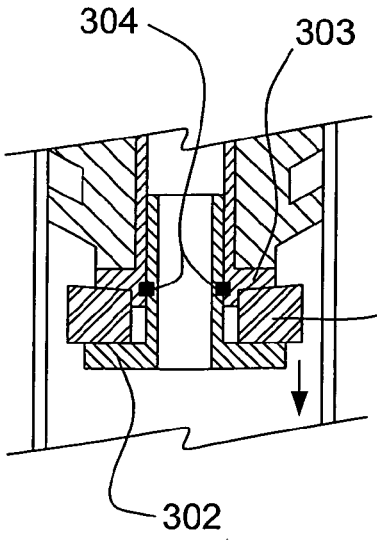

With reference to FIGS. 8*a*–8*b*, another embodiment of the wiper packer plug 300 is shown.

As shown in FIG. 8*a*, prior to actuation in a first running-in position, a soft durometer rubber packer element 301 is sandwiched between a bottom post 302, which extends upwardly into the hollow core 20 of the plug 300 and an uphole retaining shoulder 303 is formed at a bottom 306 of the plug 300. Means, such as shear screws 304, are provided to temporarily retain the post 302 in a non-actuated, non-telescoped position wherein the packer element 301 has the undeformed insertion diameter.

With reference to FIG. 8*b* and in an actuated position, the top wiper packer plug 300 is shown having been placed atop a bottom wiper plug 305 in a wellbore casing. Fluid pressure, or other force, is applied to compress the top wiper packer plug 300 onto an obstruction such as the bottom wiper plug 305. The bottom post 302 is sufficiently loaded by the force to shear the shear screws 304, permitting the bottom post 302 to telescope into the core 20 of the top wiper packer plug 300 and permit compression of the packer element 301 between the bottom post 302 and the uphole retaining shoulder 303 to the expanded diameter and into sealing engagement with the casing.

In Use

The incorporation of a packer element into the wiper plug to prevent re-entry of cement into the casing enables a method of cementing a casing into a wellbore without the need for a float shoe or other one way valves. A bottom plug is pumped to the bottom of a casing string until the plug is landed, such as on a guide shoe. A column of cement is then pumped into the casing followed by a top plug. Displacement fluid is then pumped into the casing above the top plug to provide sufficient force to the column of cement to cause a rupture element or valve in the bottom plug to open, permitting the cement to be displaced into the wellbore annulus. Continued pumping of displacement fluid into the casing actuates the packer element in the top plug to the expanded diameter for sealing against the casing, thus preventing cement from re-entering or U-tubing into the casing bore.

Advantageously, when running in the casing, the casing will fill with displacement fluid by itself without having to stop every 200–300' to add fluid. It is no longer necessary to have a one way valve to prevent fluid rising in the casing. Only when the top plug rests on the bottom plug and the packer is set by compression is fluid prevented from rising in the casing. The pressure required to compress the packer is designed to be lower than the pressure required to rupture the rupture element in the packer and thus the plug remains intact.

In another embodiment, the addition of the packer element prevents leakage of fluids below a plurality of perforations in a cemented and perforated casing. A bottom plug is pumped to the bottom of a casing string until the plug is landed on a guide shoe. A column of cement is then pumped into the casing followed by a top plug. Displacement fluid is pumped into the casing above the top plug to apply sufficient force on the column of cement to cause a rupture element in the bottom plug to open and permit the cement to be displaced into the wellbore annulus. Continued pumping of displacement fluid actuates the packer element in the top plug to the expanded diameter for sealing against the casing and preventing cement from re-entering into the casing. The pressure applied to the top plug is sufficient to compress the packer element but is lower than that which would rupture a rupture element in the top plug. The cement is permitted to harden and cure before the casing is perforated above the top plug. Regardless any damage to the cement adjacent the top plug as a result of fracturing, the packer element compressed into sealing engagement with the casing and retained in compression by the holddown fingers acts to prevent leakage of fluids uphole past the top plug.

The embodiments of the invention in which an exclusive property or privilege is claimed are defined as follows:

1. A cementing wiper plug for sealing a wellbore having a casing, comprising:

a plurality of radially extending, elastomeric wipers extending from the cementing wiper plug further comprising one or more substantially inflexible projections biased radially outward from the cementing wiper plug and angled uphole, wherein, the one or more projections are moveable inwardly sufficiently so as to permit movement downwardly into the casing and are sufficiently inflexible to engage the casing to prevent uphole movement of the cementing wiper plug in the casing; and an elastomeric packer element formed at a bottom of the cementing wiper plug, the packer element being actuable between an insertion diameter and an expanded diameter so as to engage the inside of the casing and seal the wellbore against leakage of fluids from below the cementing wiper plug when the elastomeric packer element is in the expanded diameter.

2. The cementing wiper plug as described in claim 1 wherein the packer is actuable upon compression and engagement with the casing and an obstruction in the wellbore below the cementing plug, the compression being maintained by the projections when compressive force is removed.

3. The cementing wiper plug as described in claim 2 wherein the obstruction in the wellbore is a bottom cementing plug.

4. The cementing wiper plug as described in claim 1, further comprising:

a bottom post actuable between a non-actuated, non-telescoped position and an actuated telescoped position wherein the bottom post is telescoped into a hollow core in the cementing wiper plug;

an uphole retaining shoulder formed at a bottom of the cementing wiper plug, the elastomeric element being sandwiched between the bottom post and the retaining shoulder; and means for actuating the bottom post from the non-telescoped position to the telescoped position for compressing the elastomeric element against the uphole retaining shoulder into sealing engagement with the casing.

5. The cementing wiper plug as described in claim 4 wherein the means for actuating the bottom post are shear screws.

6. A method of sealing a casing comprising:

landing a bottom wiper plug at a bottom of a casing;

landing a top wiper plug having a packer element on the bottom wiper plug; and applying a compressive force to the top wiper plug for actuating the packer element into sealing engagement with the casing.

7. The method of sealing a casing as described in claim 6 wherein the compressive force is a hydraulic force and is applied by pumping a fluid into the casing above the top wiper plug.

8. The method of sealing a casing as described in claim 6 wherein the top wiper plug further comprises one or more substantially inflexible projections biased radially outward from the cementing wiper plug and angled uphole, wherein, the one or more projections are moveable inwardly sufficiently so as to permit movement downwardly into the casing and are sufficiently inflexible to engage the casing to prevent uphole movement of the cementing wiper plug in the casing; and wherein the projections act to retain compression of the packer element when the compressive force is released.

9. A method of cementing a casing into a wellbore comprising:

pumping a bottom plug to a bottom of a casing string until the plug is landed;

pumping a column of cement into the casing string;

pumping a top plug having a packer element following the cement;

applying pressure above the top plug for releasing cement through the bottom plug to be displaced into the wellbore annulus; and actuating the packer element in the top plug to an expanded diameter for sealing against the casing and preventing cement in the annulus from re-entering the casing.

10. The method as described in claim 9, further comprising:

permitting the cement to harden and cure; and perforating the casing above the top plug, the packer element preventing leakage of fluids uphole past the top plug.

11. The method as described in claim 9 wherein the pressure is hydrostatic and is applied by pumping a fluid above the top plug.

12. The method as described in claim 11 wherein the fluid is displacement fluid.

13. The method as described in claim 9 wherein the packer is actuated using hydrostatic pressure.

14. The method as described in claim 13 wherein the hydrostatic pressure is created by pumping a fluid into the casing above the top packer.

* * * * *